US006417832B1

(12) United States Patent
Skinner et al.

(10) Patent No.: US 6,417,832 B1
(45) Date of Patent: Jul. 9, 2002

(54) APPARATUS FOR PRODUCING UNIFORM LUMINANCE IN A FLAT-PANEL DISPLAY BACKLIGHT

(75) Inventors: Dean W. Skinner, Vestal, NY (US); Lawrence T. Guzowski, Newington, CT (US)

(73) Assignees: Rainbow Displays, Inc., Endicott, NY (US); Performance Display Systems, Inc., Newington, CT (US)

( * ) Notice: Subject to any disclaimer, the term of this patent is extended or adjusted under 35 U.S.C. 154(b) by 0 days.

(21) Appl. No.: 09/406,977

(22) Filed: Sep. 28, 1999

(51) Int. Cl.[7] ..... G09G 3/36

(52) U.S. Cl. ..... 345/102; 345/109; 349/58; 362/29

(58) Field of Search ..... 345/102, 104, 345/109; 362/223, 97, 556, 29–30; 353/122; 313/522; 349/50–60

(56) References Cited

U.S. PATENT DOCUMENTS 4,748,546 A * 5/1988 Ukrainsky ..... 362/223
5,183,323 A * 2/1993 Daniel ..... 362/556
5,593,221 A * 1/1997 Evanicky et al. ..... 353/122
5,661,531 A 8/1997 Greene et al. ..... 349/73
5,831,816 A * 11/1998 Johns et al. ..... 361/681
5,844,364 A * 12/1998 Beardmore ..... 313/522
5,867,236 A 2/1999 Babuka et al. ..... 349/73
6,095,656 A * 8/2000 Shimura et al. ..... 362/97
6,104,451 A * 8/2000 Matsuoka et al. ..... 349/58

* cited by examiner

*Primary Examiner*—Steven Saras
*Assistant Examiner*—Uchendu O. Anyaso
(74) *Attorney, Agent, or Firm*—Salzman & Levy

(57) ABSTRACT

The present invention features apparatus for uniformly distributing luminance from a back light module for a flat panel, liquid crystal display (LCD). Luminance uniformity, high efficiency and long lamp life are achieved by distributing the lamp cathode thermal energy and maintaining uniform lamp wall temperatures. A heat sink is attached to the fluorescent lamps in the cathode areas, providing cooler operating temperatures at the lamp ends. A thermal sensor is also mounted in the heat sink body. In addition, open louver slots positioned behind the lamps allow for cool air to enter behind each lamp. The size, shape and position of these louvers can be selected so that the lamp temperatures are essentially constant over their entire length.

22 Claims, 7 Drawing Sheets

APPARATUS FOR PRODUCING UNIFORM LUMINANCE IN A FLAT-PANEL DISPLAY BACKLIGHT

FIELD OF THE INVENTION

This invention pertains to apparatus for producing uniform, high luminance light and, more particularly, to a system for producing uniform, high luminance light in a large area, back light system for flat panel displays.

BACKGROUND OF THE INVENTION

Large flat-panel displays made in accordance with known active matrix (or TFT) liquid crystal display technologies are typically mounted in front of a back light module which L contains an array of fluorescent lamps. FPDs of this type have been increasing in size annually by about 1 to 2 inches, diagonally. The median size in 1999 for use in desktop PCs was about 15 inches diagonal view area. A few very large displays are made in the range of 20 to 25 inches diagonal. Tiled AMLCD FPDs may be made in the range of 40 inches diagonal, as described in copending U.S. patent application Ser. No. 09/368,921, assigned to the common assignee and hereby incorporated by reference.

However, tiling, as described in U.S. Pat. No. 5,661,531, and also included by reference, requires extremely intense light sources with substantially collimated lighting, masked optical stacks, and pixel apertures that have very low emitted light efficiency. Thus, lighting with unusually high intensity ranges of 50,000 to 150,000 nits is desirable with uniformity over very large FPD areas. Unique designs and control features are necessary to achieve such high intensities at reasonable wattages for consumer or business applications.

Maintaining such a bright illumination uniformly over the entire active area of the display is difficult to do. The intensity required for some applications, and in particular, that required for a large tiled flat panel LCD display as described in U.S. Pat. No. 5,867,236, issued Feb. 2, 1999, entitled CONSTRUCTION AND SEALING OF TILED, FLAT-PANEL DISPLAYS, causes the lamps to produce a significant amount of heat. Moreover, fluorescent lamps are designed to run most efficiently at an elevated temperature, so it is desirable to operate them at a predetermined ideal design temperature, which is usually in the range of 50 to 60 degrees Centigrade.

Small, edge-lit, back light modules used in notebook or laptop PCs do not produce sufficient brightness for a large area display, nor are they capable of illuminating a large area uniformly. Thus it is necessary to illuminate the area with an array of fluorescent lamps. The number of lamps required depends on the size of the area to be illuminated and the display brightness specifications. A large area display needs multiple lamps to illuminate it properly.

Since most displays are designed to be wider than they are tall, it is advantageous from a reliability and power perspective to use horizontal lamps. This results in fewer lamps and less power, since fewer lamp cathodes are required. The resultant designs use lamp tubes placed horizontally, one above the other. This produces a chimney effect, the upper lamps receiving heated air from the lamps below. As expected, the temperature differential from top to bottom can become severe. Unfortunately, lamp tube temperature differences cause significant variations in the luminance of the back light and contribute to decreased life expectancy.

Fluorescent lamps, particularly high efficiency hot cathode types, operate with a significant amount of the power consumption at the ends (cathodes). This naturally produces high temperatures at the cathodes of the lamp tube. A typical lamp operates in open air with a tube wall temperature preferably at about 55 degrees Centigrade, while the end may be higher than 85 degrees.

This invention provides a unique conduction cooling structure means for uniformly distributing the heat generated by the lamp tube cathodes, thus helping to maintain maximum brightness by keeping all of the lamp tube ends at or very near a uniform temperature. The temperature of the lamp ends is kept near the temperature of the central section of the lamp tube, preferably about 55° C., which provides for uniform brightness along the lamp tube within a few percent at peak efficiencies and ensures the longest possible lamp life.

This invention further provides unique means for directing cool fresh air to impinge on predetermined portions of lamp tubes so as to develop cooling means and uniform temperature distributions in the stack of bulbs. The invention is also capable of providing a more uniform temperature distribution across the array of lamp tubes in a high luminance output back light module for a large area flat panel display.

Additionally, when used in combination with the invention disclosed in copending U.S. patent application Ser. No. 09/407,619 (RDI-125), filed Sep. 28, 1999, hereby incorporated by reference, the present invention provides a very uniform, high luminance back light system capable of maintaining brightness within a few percent over periods of days under a wide range of environments. It is particularly suited for the application of a back light system for a large tiled, flat panel LCD. Such an application is disclosed in copending U.S. patent applications, Ser. No. 09/409,620 (RDI-127), filed Sep. 28, 1999 and Ser. No. 09/368,291, filed Aug. 6, 1999, both also incorporated herein by reference.

SUMMARY OF THE INVENTION

In accordance with the present invention, there is provided apparatus for uniformly distributing luminance from a back light module for a flat panel, liquid crystal display (LCD). Fluorescent lamps are commonly used in back light modules for LCDs due to their high efficiency. Luminance from fluorescent lamps is a function of lamp tube temperature, as is the efficacy of the lamp and the operating life thereof. This invention provides means for achieving luminance uniformity, high efficiency and long life by distributing the lamp cathode thermal energy and maintaining uniform lamp wall temperatures.

A unique heat sink attachment conduction cools the cathode areas of the fluorescent lamps. Cooler operating temperatures are achieved at the lamp ends, which has two significant benefits. First, the lower operating temperature of the cathode increases the lamp life, and second, provides for more even distribution of temperature and, therefore, uniform lamp luminance output in the range of a few percent over the length of the tube. A thermal sensor is also mounted in the heat sink body. In addition, open louver slots positioned behind the lamps allow for cool air to enter behind each lamp. The size, shape and position of these louvers can be selected so that the lamp temperatures are essentially constant over their entire length.

A constant and uniform luminance output of the back light module is further obtained through appropriate selection of lamps, reflective back light cavity and light diffuser. This invention provides means for achieving very high and uniform luminance output, 35,000 to 150,000 nits, over a very large surface area at minimal power consumption through appropriate design of the cathode heat sinks in conjunction with a set of specific air inlet louvers.

The cathode heat sinks also provide an optimum location for locating a temperature sensor. The sensor can be used in a control system, such as that described in the aforementioned patent application, Ser. No. 09/407,619, to efficiently manage the back light output.

BRIEF DESCRIPTION OF THE DRAWINGS

A complete understanding of the present invention may be obtained by reference to the accompanying drawings, when considered in conjunction with the subsequent, detailed description, in which.

For purposes of both clarity and brevity, like elements and components will bear the same designations and numbering throughout the figures.

DESCRIPTION OF THE PREFERRED EMBODIMENT

Generally speaking, the invention features apparatus and a method for controlling the luminance uniformity of a large area back light for a large, tiled, flat panel display that requires high luminance levels. In addition, the invention provides an optimum location for a temperature sensor for controlling the back light for optimized efficiency, lamp life and safe operation.

Figure 1:
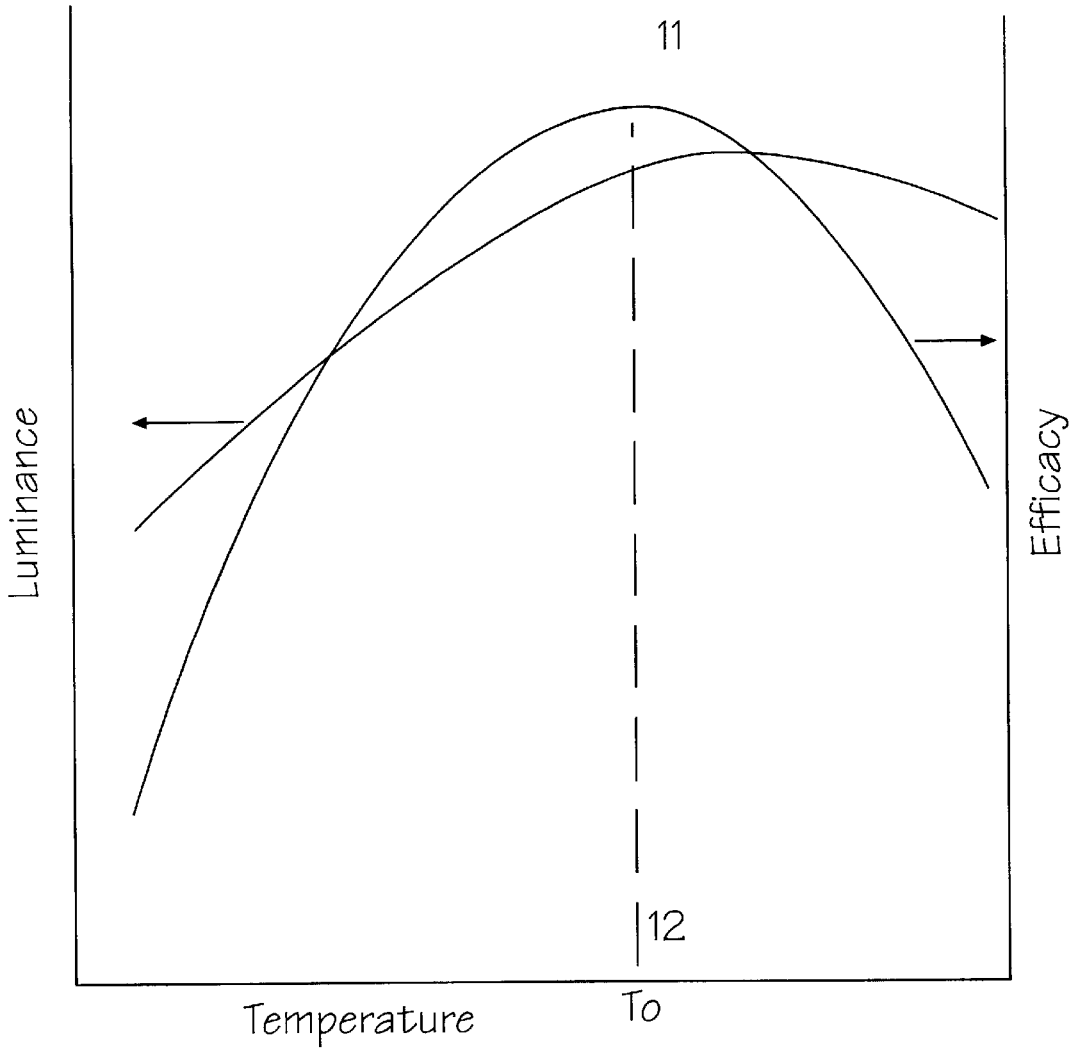
FIG. 1 is a graphical illustration of the temperature characteristics of a fluorescent lamp.

Now referring to FIG. 1, a typical fluorescent lamp is designed to operate most efficiently at a predetermined lamp tube wall temperature. Maximum brightness occurs near the point of maximum efficacy 11. The ideal temperature then is said to be $T_0$12. The ideal temperature 12 is determined by the construction of the lamp (not shown in this FIGURE) and its components and parameters, such as phosphors and mercury vapor pressure. The most efficient lamps are those referred to as hot cathode lamps. These lamps have a preheat cycle during which the cathodes are heated, thereby causing easier ignition of the gas.

Figure 2A:
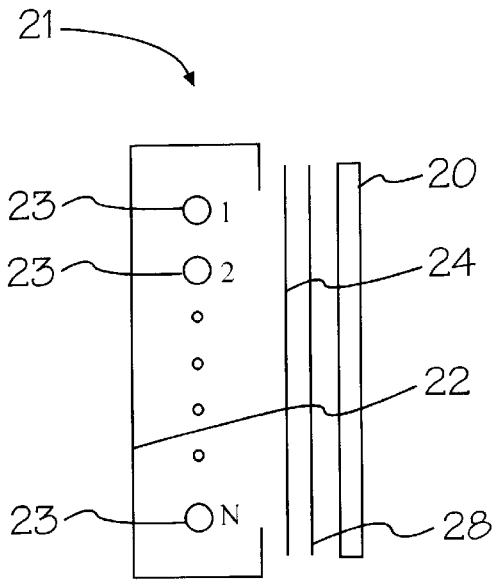
FIG. 2*a* illustrates a side view of a multiple lamp back light and a display.

Now referring to FIG. 2*a,* a side view of a flat panel display 20 and its back light assembly 21 is shown. The back light assembly 21 consists of a light box cavity 22, an array of fluorescent lamps 23, and a light diffuser 24. One or more fans 29 are mounted to the lamp enclosure to cool the assembly. Some display applications require additional optics 28 to enhance certain characteristics of the exiting light. An example is the aforementioned tiled, flat panel LCD display, for which highly collimated light is required. The additional optics 28 required to perform this collimating function is relatively inefficient; therefore, it is necessary for high luminance to be produced by the back light 21.

Figure 2B:
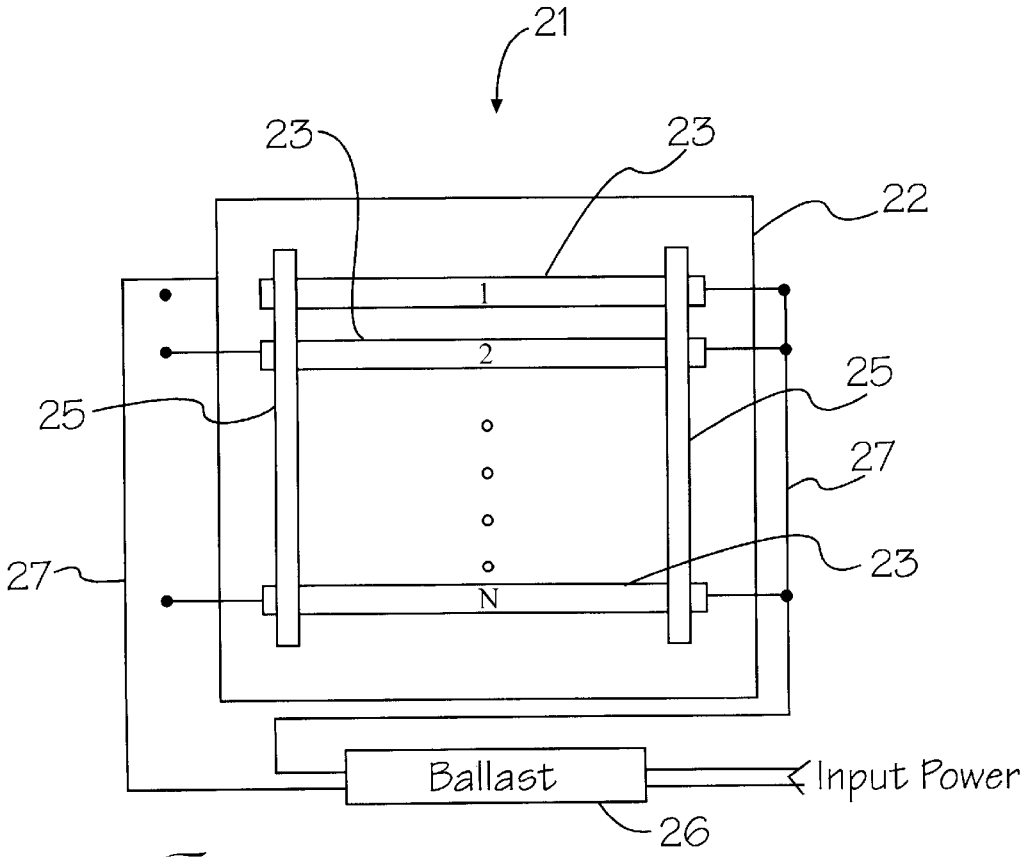
FIG. 2*b* illustrates a planar view of the multiple lamp back light depicted in FIG. 2*a;*

FIG. 2*b* shows a front view of the back light assembly 21 depicted in FIG. 2*a*. The lamps 23 are held in the light box cavity 22 by lamp holders 25. The lamps 23 are wired to a ballast 26 by a wiring harness 27. The ballast supplies high frequency (usually 20–30 Khz) AC power to the lamps 23.

Figure 3:
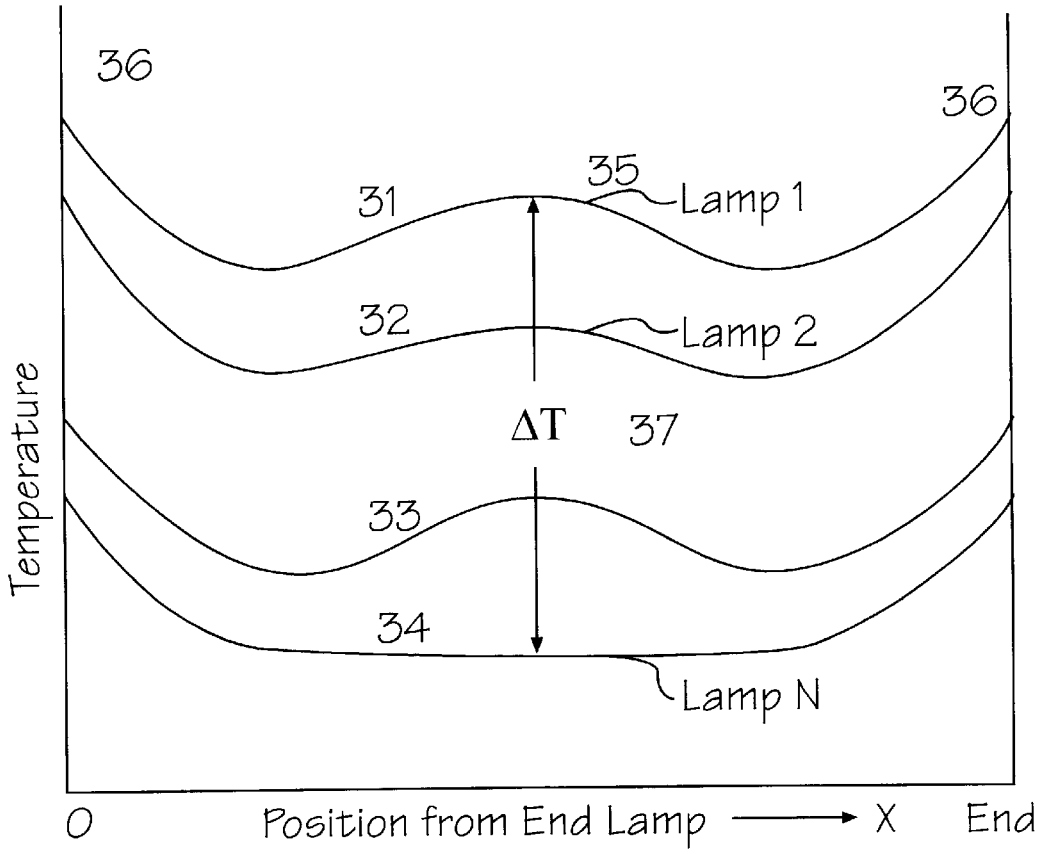
FIG. 3 graphically illustrates the thermal profiles of lamps in a back light module when operated with only natural convection cooling in an uncontrolled back light.

Referring now also to FIG. 3, illustrated are typical thermal profiles of the lamps in the back light module 21 when operated with only natural convection cooling. The temperature of the lowermost lamp 34 is the lowest, the temperature increasing for lamps 33, 32 and the topmost lamp 31. The cathode areas 36 or ends of the lamps 23, shown at the extreme positions along the X-axis of the graph, have higher temperatures due to the power consumption of the cathodes 36. The cathode area 36 of a high efficiency, hot cathode, fluorescent lamp 23 usually operates at a significantly higher temperature than does the rest of the lamp tube.

Also shown is the effect of the thermal chimney on the temperature of the center of the lamps 35 as air passes over the lamps 23. Lamp 31 is heated not only by the power supplied it, for example, but also by the rising warm air from all of the lamps 32, 33, 34 below it. The resultant operating lamp temperature range 37 is quite large. The object of this invention is to provide two different, yet complimentary, means for reducing this temperature range 37.

Figure 4:
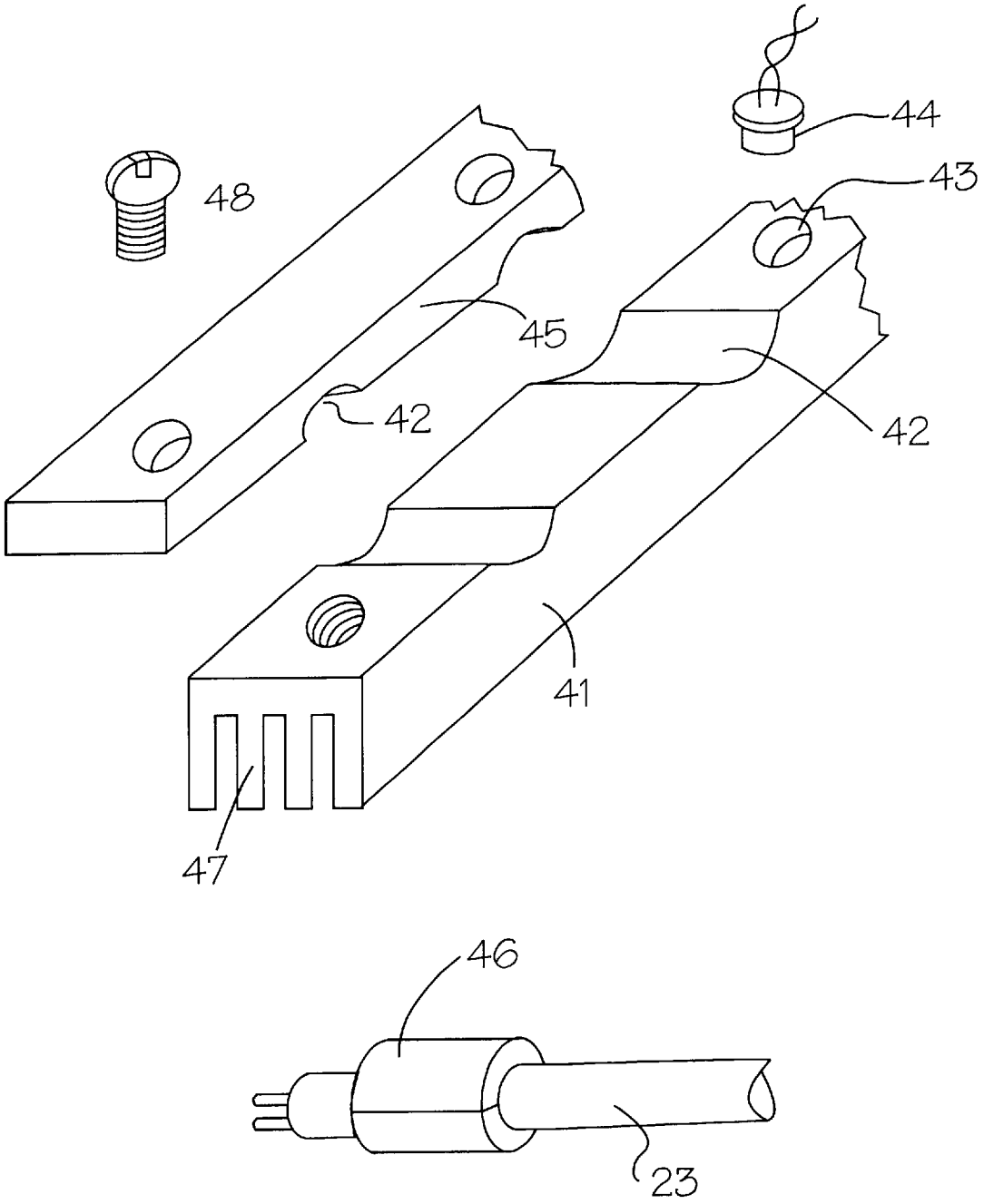
FIG. 4 depicts a heat sink used to cool the lamp ends, in accordance with the present invention.

FIG. 4 is an exploded view of a cathode heat sink assembly 40 in accordance with the invention. The heat sink assembly 40 serves as a lamp holder 25 as well. The heat sink assembly 40 covers the cathode area 36 of the fluorescent lamps 23. The heat sink assembly 40 consists of two mating parts: the heat sink body 41 and the heat sink cap 45. Both of these two parts 41 and 45 have respective, "essentially" semicircular cavities 42 for receiving lamps 23. The two mating parts 41 and 45 are held together by fasteners 48.

Prior to placing the lamps 23 into the heat sink cavities 42, thermally conductive elastomeric tape 46 is placed around the lamps 23 in the cathode area 36. The thermal tape 46 provides compliance so that the lamp tubes 23 are not overly stressed during assembly. High viscosity thermal grease can be used in conjunction with the tape.

A thermal sensor 44 is mounted in the heat sink body 41 using thermal adhesive. The heat sink temperature is uniform across the lamps 23 and is an excellent mounting surface for the sensor 44. The temperature at the top of the heat sink 40 is the most indicative of the lamp temperatures in the back light cavity 22. The temperature at the sensor 44 represents all of the lamp cathode heat plus some of the heat produced in the chimney of the lamp array 23. The output of the sensor can be used to regulate the speed of fans 29.

The heat sink assembly 40 is mounted in the back light cavity 22 with cooling fins 47 protruding from the rear of the cavity 22. This provides for cool ambient air to convectively flow over the heat sink fins 47. This additionally allows the heat sink 40 to be at a near uniform temperature. The sensor 44 is located at an optimum thermal location for use in a temperature control system.

Figure 5:
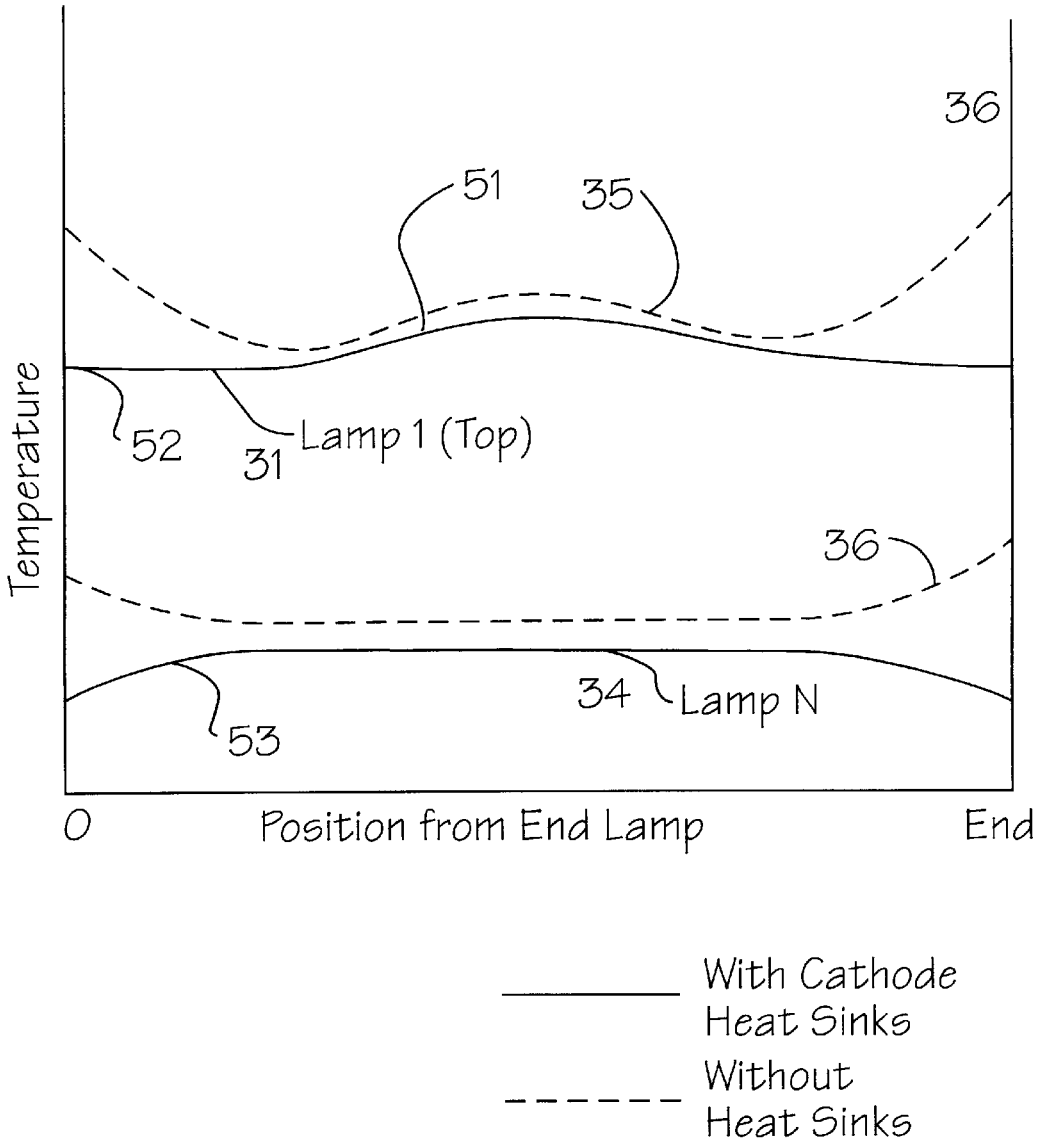
FIG. 5 graphically illustrates the temperature distribution with the heat sink.

Now referring also to FIG. 5, temperature profiles along the lamp tubes 23 are shown for the top lamp 31 and bottom lamp 34 in the back light assembly 21. The central portions of the lamps 35 have an elevated temperature 51 due to the chimney effect. The addition of the heat sink assembly 40 in the cathode areas 36 of the lamps 23 does not change the temperature 51 in the central area of the lamp 35. The addition of heat sinks 40 on the lamp end temperatures 52, 53 is depicted on this graph. The top lamp 31 has a temperature 36 near the lamp ends or cathode areas, prior to installing heat sink 40. The heat sink 40 reduces the lamp end temperature 52 near to that at the bulk of the lamp. The bottom or coolest lamp 34 in the array 23 shows that the cathode area temperature 36 may be slightly overcooled to a temperature 53.

The remaining problem in obtaining lamp temperatures along the lamp tube length is the elevated temperatures 51 at the central portion 35 of the uppermost lamps 31 and 32. As mentioned hereinabove, this phenomenon is a result of the previously mentioned chimney effect. A heat sink cannot be attached to the central portion of these lamps, since it would be in the field of view and would present an objectionable optical artifact. A solution would be to inject cool air into the cavity 22 near the upper lamps 31 and 32. Of course, the mechanism to perform this cool air injection process must not be visible to the user.

Figure 6A:
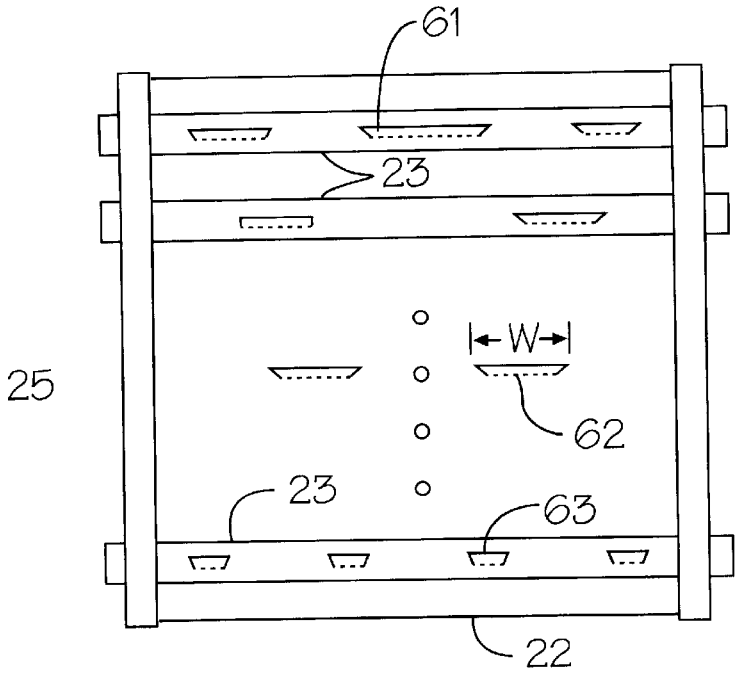
FIG. 6 depicts a back light cavity back plane with louvers.

Referring now to FIG. 6*a,* there is shown an array of louvers, or open slots, dispersed behind the lamps 23. Different size louvers 61, 62 and 63 are used for thermal balancing. The louvers 61, 62 and 63 are punched into the back plane of the back light cavity 22. This plane is a highly efficient, diffusive reflector and requires that the louver surface be reflective as well. The louvers 61, 62 and 63 present no visible slot to the viewer. The diffusive reflectivity characteristic of the back plane allows this to be viable.

Figure 6B:
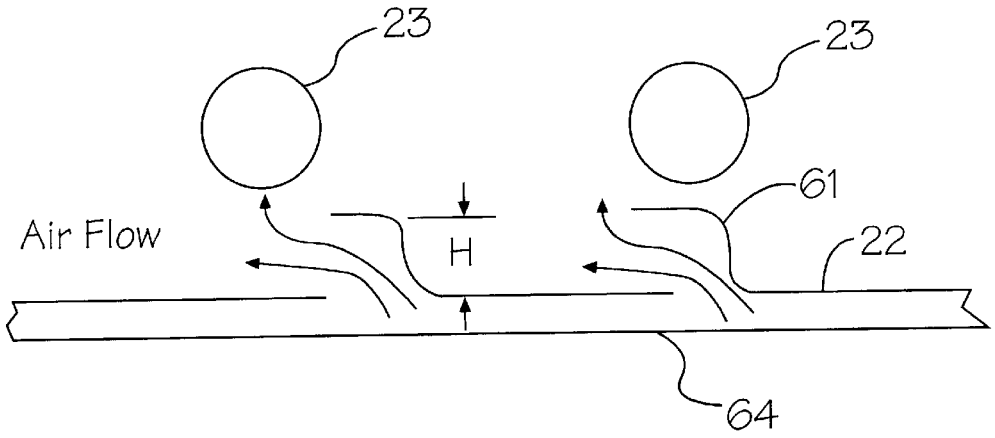

In summary, the lamp tubes 23 can be made to operate at a uniform temperature along their entire length by allowing cool ambient air pulled by fans 29 to enter the back light cavity 22 through louvers 61, 62 and 63 placed behind the lamps 23. A filter 64 is placed behind the back light cavity 22, as shown in FIG. 6*b*.

The height H and width W of the louvers 61, 62 and 63 can be determined experimentally, guided by analysis. It is desired that the air temperature and flow rate be constant along the lamp tube length. To counterbalance the chimney effect, larger and more numerous louvers are needed at the top of the lamp array 23 and near the horizontal center. The objective is to maintain each lamp at a uniform temperature along its length, but not necessarily to maintain the same temperature from lamp to lamp.

Figure 7:
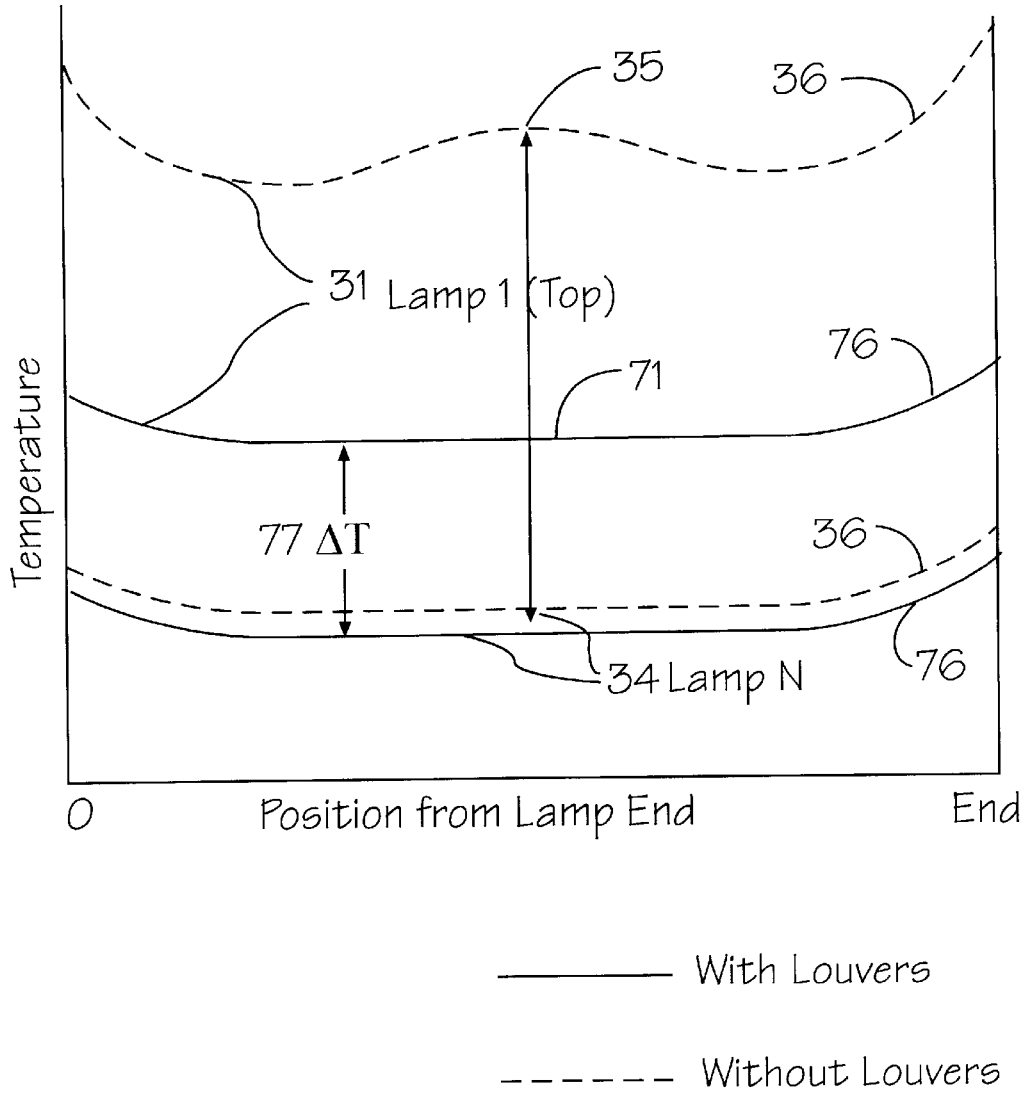
FIG. 7 graphically illustrates the temperature distribution with louvers.

FIG. 7 shows the result of incorporating an appropriate combination of louvers 61, 62 and 63 in a back light cavity 22. The louvers 61, 62 and 63 have little effect on the lower lamp 34 and essentially no effect in lamp end temperatures 36 versus non-louvered lamps shown as reference numeral 76 on the lower lamp 34. The temperature of the upper lamp 31 at the center region 35, prior to the introduction of louvers 61, 62 and 63, is shown-at reference numeral 75. After allowing fresh air to impinge on lamp 31 by louver 61 and by reducing the air temperature reaching lamp 31 by the effects of louvers 62 and 63 placed below lamp 31, the temperature of lamp 31 is reduced to a lower temperature 71. The lamp temperature gradient in the back light 21 reduces from a high range 37 to a new lower range 77.

The combination of heat sink assemblies 40 and non-visible back plane air inlet louvers 61, 62 and 63 permits the construction of a back light assembly 21 in which the lamp temperature, and therefore lamp luminance, is very uniform. Additionally, a thermally stable and optimum location for a temperature sensor 44 is provided for use in a temperature control system.

Since other modifications and changes varied to fit particular operating requirements and environments will be apparent to those skilled in the art, this invention is not considered limited to the example chosen for purposes of this disclosure, and covers all changes and modifications which does not constitute departures from the true spirit and scope of this invention.

Having thus described the invention, what is desired to be protected by Letters Patent is presented in the subsequently appended claims.

What is claimed is:

1. A back light apparatus for use with a large-area, flat-panel display, comprising:

a) a housing having a light output region;

b) an array of tubular fluorescent lamps each of said lamps having at least cathodes, said array of lamps being disposed within said housing; and c) a thermally conductive heat sink substantially encircling at least one tubular fluorescent lamp of said array of lamps, said heat sink being in direct thermal contact with said at least one lamp proximate at least a cathode region thereof;

whereby the temperature and temperature gradient along said cathodes of said array of fluorescent lamps is reduced below a predetermined value.

2. The back light apparatus for use with a large-area, flat-panel display as recited in claim 1, wherein said array of fluorescent lamps is mounted substantially horizontally in said housing.

3. The back light apparatus for use with a large-area, flat-panel display, as recited in claim 2, wherein said housing comprises louvers proximate said array of lamps whereby outside air may enter said housing and cool said array of fluorescent lamps by convection thereby maintaining a substantially uniform temperature gradient along each of said lamps.

4. The back light apparatus for use with a large-area, flat-panel display, as recited in claim 3, wherein said louvers comprise a plurality of intermittent, horizontal louvers each being proximate at least one lamp of said array of fluorescent lamps.

5. The back light apparatus for use with a large-area, flat-panel display, as recited in claim 4, wherein each of said plurality of intermittent, horizontal louvers comprises a predetermined pattern of louvers whereby said outside air is directed substantially toward a predetermined region of said at least one lamp to control temperature gradient therealong.

6. The back light apparatus for use with a large-area, flat-panel display, as recited in claim 5, wherein each of said predetermined patterns of louvers is a different, predetermined pattern.

7. The back light apparatus for use with a large-area, flat-panel display, as recited in claim 5, wherein said predetermined patterns of louvers forms an array of predetermined patterns interacting in concert to minimize said temperature gradients along each of said lamps and across said array of fluorescent lamps.

8. The back light apparatus for use with a large-area, flat-panel display, as recited in claim 5, wherein said louvers are constructed to substantially eliminate outside light from entering said housing.

9. The back light apparatus for use with a large-area, flat-panel display, as recited in claim 1, further comprising:

d) temperature sensing means operatively connected to said heat sink; and e) temperature control means operatively connected to said temperature sensing means for controlling the temperature within said housing.

10. The back light apparatus for use with a large-area, flat-panel display, as recited in claim 9, wherein said temperature control means comprises at least one fan.

11. The back light apparatus for use with a large-area, flat-panel display, as recited in claim 10, wherein said at least one fan comprises a variable-speed fan operatively connected to said temperature control means.

12. The back light apparatus for use with a large-area, flat-panel display, as recited in claim 1, wherein said thermally conductive heat sink comprises an integral lamp holder in close thermal contact with said array of fluorescent lamps.

13. The back light apparatus for use with a large-area, flat-panel display, as recited in claim 12, wherein said thermally conductive heat sink comprises a heat sink assembly which extends through a wall of said housing.

14. The back light apparatus for use with a large-area, flat-panel display as recited in claim 13, further comprising:

f) light diffusing means located proximate said array of fluorescent lamps and defining a light output region of said housing.

15. A back light apparatus for use with a large-area, flat-panel display, comprising:

a) a housing having a light output region;

b) an array of tubular fluorescent disposed horizontally in said housing, each having at least cathodes;

c) temperature sensing means proximate at least one of said array of tubular fluorescent lamps for generating an output signal representative of a temperature proximate said at least one of said tubular fluorescent lamps;

d) louver means proximate said array of tubular fluorescent lamps; and e) at least one variable speed fan proximate said louver means and operatively connected to said temperature sensing means and adapted to vary its speed in response to said output signal;

whereby outside air enters said housing and impinges upon said array of fluorescent lamps thereby reducing the temperature gradient along each of said tubular lamps and the temperature gradient across said array of tubular fluorescent lamps.

16. The back light apparatus for use with a large-area, flat-panel display, as recited in claim 15, wherein said louvers comprise a plurality of intermittent, horizontal louvers each being proximate at least one lamp of said array of tubular fluorescent lamps.

17. The back light apparatus for use with a large-area, flat-panel display, as recited in claim 16, wherein each of said plurality of intermittent, horizontal louvers comprises a predetermined pattern of louvers whereby said outside air is directed substantially toward a predetermined region of said at least one lamp to control temperature gradient therealong.

18. The back light apparatus for use with a large-area, flat-panel display, as recited in claim 17, wherein each of said predetermined patterns of louvers is a different, predetermined pattern.

19. The back light apparatus for use with a large-area, flat-panel display, as recited in claim 18, wherein said predetermined patterns of louvers forms an array of predetermined patterns interacting in concert to minimize said temperature gradients along each of said lamps and across said array of fluorescent lamps.

20. The back light apparatus for use with a large-area, flat-panel display, as recited in claim 19, wherein said louvers are constructed to substantially eliminate outside light from entering said housing.

21. The back light apparatus for use with a large-area, flat-panel display as recited in claim 20, further comprising:

f) light diffusing means located proximate said array of fluorescent lamps and defining a light output region of said housing.

22. A back light apparatus for a flat-panel display, comprising: at least one hot-cathode fluorescent lamp disposed proximate said display; a heat sink in close thermal contact with said lamp proximate said hot cathode; a thermal sensor in close thermal contact with said heat sink; and a variable speed fan adapted to force air past said heat sink at a speed determined by an output from said thermal sensor.

* * * * *